United States Patent [19]

Suchdev et al.

[11] Patent Number: 4,626,126

[45] Date of Patent: Dec. 2, 1986

[54] CONNECTOR MEMBER

[75] Inventors: Jagan N. Suchdev, Woodridge; Mark Dailey, Chicago, both of Ill.

[73] Assignee: General Motors Corporation, Detroit, Mich.

[21] Appl. No.: 652,720

[22] Filed: Sep. 21, 1984

[51] Int. Cl.[4] ..... B25G 3/38

[52] U.S. Cl. ..... 403/353; 72/364; 339/278 C; 339/47 R

[58] Field of Search ..... 72/364; 339/278 C, 47, 339/49; 403/353, 393

[56] References Cited

U.S. PATENT DOCUMENTS

| | | | |
|---|---|---|---|
| Re. 23,869 | 9/1954 | Macy | 403/353 |
| 534,732 | 2/1895 | Titcomb . | |
| 1,642,696 | 9/1927 | Rateike . | |
| 1,689,824 | 10/1928 | Goelz . | |
| 1,834,150 | 12/1931 | Goelz . | |
| 1,993,295 | 3/1935 | Cummins . | |
| 2,288,192 | 6/1942 | Hegenauer | 339/47 C |
| 2,449,660 | 9/1948 | Lawhorne | 339/47 R |
| 2,480,280 | 8/1949 | Bergan . | |
| 2,636,071 | 4/1953 | Matthysse | 403/353 X |
| 3,040,292 | 6/1962 | Bernard et al. . | |
| 3,233,211 | 2/1966 | Smith | 339/278 C |
| 3,316,522 | 4/1967 | Demler | 403/353 X |
| 3,419,843 | 12/1968 | Hays | 339/47 R |
| 3,480,903 | 11/1969 | Filson | 403/353 X |
| 3,973,823 | 8/1976 | Stanback et al. . | |
| 3,998,520 | 12/1976 | Zemels | 339/278 C X |
| 4,209,221 | 6/1980 | Chupak et al. . | |
| 4,290,665 | 9/1981 | Krasnov et al. | 339/278 C X |
| 4,442,182 | 4/1984 | Chart | 339/278 C X |

FOREIGN PATENT DOCUMENTS

| | | | |
|---|---|---|---|
| 1108263 | 8/1955 | France | 339/278 C |

*Primary Examiner*—Cornelius J. Husar
*Assistant Examiner*—Joseph A. Fischetti
*Attorney, Agent, or Firm*—Robert J. Outland

[57] ABSTRACT

A connector member, connectable with a like member to form an electrical clasp connector for locomotive traction motor cables and the like, has a soft socket and for crimping on a cable and a harder connecting blade end for wear resistance preferably extruded from a slug of copper in separate steps respectively before and after annealing. Alternative lock means and methods of forming are also disclosed.

8 Claims, 11 Drawing Figures

CONNECTOR MEMBER

TECHNICAL FIELD

This invention relates to electrical cable clasp connectors of a type used for connecting heavy electrical cables such as those used on diesel-electric locomotive traction motors and the like, as well as to methods of making such connectors.

BACKGROUND

U.S. Pat. No. 1,834,150 Goelz discloses an electrical cable clasp connector of a general type which has been in use for many years for connecting the cables of DC electric traction motors and their associated means of power supply, such as generators.

At present, such connectors are commonly manufactured by machining their individual members from solid bars of free cutting brass or similar material. This process yields a relatively heavy connector of moderate electrical and thermal conductivity, in the production of which about 40% of the original material is machined away as scrap. Also the resulting part is generally characterized by uniform hardness, sufficient to resist excessive wear of the blade and slot portion of the connector due to engagement and disengagement of the mating members during use over a substantial number of years.

In currently used designs, the common method of attaching the electrical cable to the tubular barrel (or socket) portion of the connector is to insert an insulation-free end of the cable into the tubular barrel and solder the cable in place. Thus, current designs differ from that illustrated in U.S. Pat. No. 1,834,150 by the absence in the barrel portion of a provision for internally receiving any of the cable insulation. While press fitting of the cable into the barrel might be possible, the use of crimping to assist the electrical connection of the present connector design with a cable is essentially precluded by the hardness of the material and the thickness of the barrel. In view, primarily, of the cost of manufacture and installation of such connectors, there has existed a need for improved connectors capable of being made and installed at lower cost and having other improved features conducive to their use as traction motor cable connectors and the like.

SUMMARY OF THE INVENTION

The present invention relates to improved cable connector members capable of providing lower manufacturing and installation costs as well as improved electrical and thermal conductivity properties in both the material of the connector and its connection to the cable. These advantages are provided by a connector member made of an extrudable copper material of high electrical conductivity, with modifications in the design of the connector to provide for its formation by extrusion in a process that yields a soft crimpable barrel (or socket) portion and a harder wear resistant blade, or tongue, and slot portion for resisting wear. The design and manufacturing process combine to minimize manufacturing scrap and machining so as to reduce both material and labor costs as well as resulting in lighter weight for the finished part.

These and other features and advantages of the invention will be more fully understood from the following description of the novel connector member and its method of manufacture taken together with the accompanying drawings.

BRIEF DRAWING DESCRIPTION

DETAILED DESCRIPTION

Figure 1:
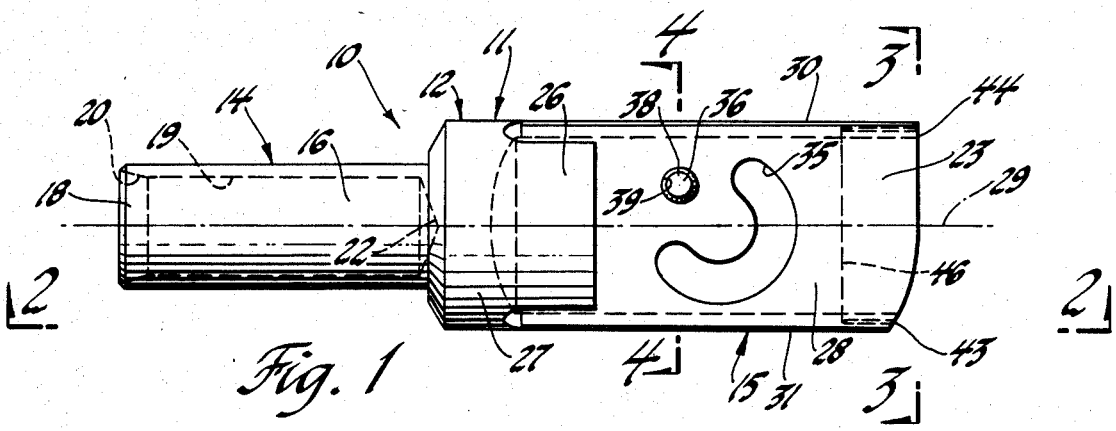
FIG. 1 is a side view of a connector member formed in accordance with the invention.

Referring now to FIGS. 1–4 of the drawings in detail, numeral 10 generally indicates an electrical connector member formed in accordance with the invention. Connector member 10 is adapted to be connected with another member of identical, or sufficiently similar, character to comprise a pair of members making up a connector for connecting or disconnecting the electrical cables of traction motors and the like in a manner known in the prior art as represented by U.S. Pat. No. 1,834,150 Goelz.

Connector 10 includes an integral body 11 having a compact central portion 12 of generally circular cross-section. A tubular barrel, or socket, portion 14 extends longitudinally from one end of the central portion while a blade portion 15 extends longitudinally oppositely from the central portion's other end.

The barrel portion comprises a relatively thin annular wall 16 having an open end 18 to define a socket with an axial pocket or recess 19, tapered at the outer edge 20 to assist the entry of the uninsulated end of an electrical cable into, and extending to the bottom 22 of, the pocket 19.

The material of the body 11 is preferably a high purity extrudable copper of high electrical conductivity, such as Copper Development Association CDA110 copper. The barrel portion 14 is preferably annealed to a dead soft condition and the wall 16 is made sufficiently thin to permit crimping of the barrel portion onto an inserted cable (not shown) to provide a high conductivity electrical connection between the two and positively retain the connector in place on the end of the cable.

The outer diameter of the barrel portion 14 is generally smaller than that of the central portion 12. However, it need not be smaller, as its diameter is essentially determined by the size of the cable to which the connector is adapted to be attached and the thickness of the wall 16, which must be capable of being crimped upon the cable inserted into the barrel portion and yet be sufficiently strong to retain the connector in position without substantial yielding after crimping.

The blade portion 15 of the connector member includes a generally flat elongated blade or tongue 23 separated by a slot 24, approximately equal to the width of the blade, from a relatively short lug or jaw 26. The lug 26 is placed so that its outer surface comprises an extension of the generally cylindrical outer surface 27 of the central portion 12. The blade or tongue 23 is, on the other hand, more centrally located, having a generally flat inner surface 28 which is coplanar with the longitudinal axis 29 of the connector member. Upper and lower edges 30, 31, respectively, of the blade 23 thus define extensions of the circular outer surface 27 of the central portion 12. However, a portion 32 of the outer surface of the blade is made essentially flat so as to lie substantially inwardly from the adjacent outer surface 27 of the central portion 12.

In accordance with the foregoing, a substantial lessening of material used in the connector of the present invention is accomplished, as compared to the arrangement of U.S. Pat. No. 1,834,150, both by flattening of the outer portion 32 of the blade and by reduction of the outer diameter of the barrel portion 14 as compared to the central portion 12.

Along the inner surface 28 of the blade 23 and intermediate its ends, the connector member is provided with a lock portion consisting of an arcuate recess 35 and an upstanding projection 36. This projection 36, in the embodiment of FIGS. 1–4, takes the form of a separate pin 38 received in an opening 39 extending through the blade 23. The recess 35 is preferably formed by displacing metal downwardly from adjacent the inner surface 28 of the blade, causing a corresponding projection 40 to extend upwardly from the outer surface 32 of the blade. This projection 40 has no function in the present design and if desired, may be removed.

Figure 5:
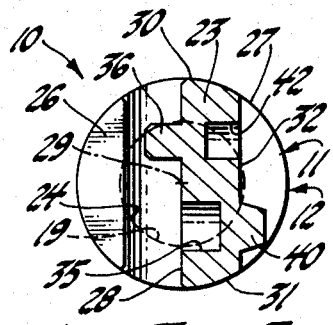
FIG. 5 is a cross-sectional view similar to FIG. 4 but showing an alternative embodiment of locking protrusion for the connector in accordance with the invention.
Figure 4:
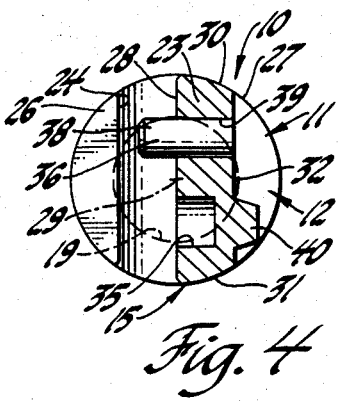
FIG. 4 is a cross-sectional view through the lock area of the connector at the plane indicated by the line 4—4 of FIG. 1.
Figure 3:
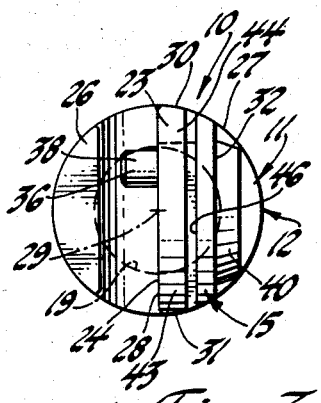
FIG. 3 is a blade-end view of the connector from the plane indicated by the line 3—3 of FIG. 1.

In FIG. 5, there is disclosed an alternative embodiment of connector member wherein like reference numerals indicate like features. In this embodiment, the projection 36, instead of being formed by a separate pin, is made by deforming metal of the blade upwardly from the inner surface 28 forming not only the projection 36 but an opposite recess 42 opening into the blade outer surface 32. This recess has no function in the operation of the connector.

Like the circular groove 6 and lug 7 of U.S. Pat. No. 1,834,150, the arcuate recess 35 and projection 36 of the present connector are formed at equal distances from a common transverse axis. However, unlike the prior patent, they do not occupy the same space. The arcuate recess 35 is made less than a complete circle to assist its manufacture by extrusion. It need be only sufficiently long to provide the locking function desired.

Figure 2:
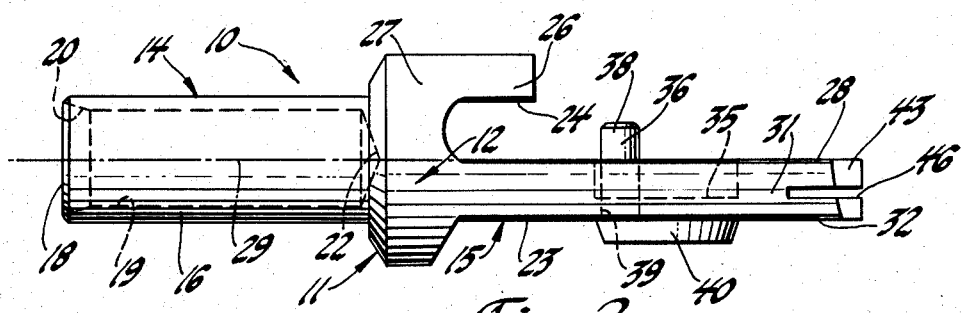
FIG. 2 is a bottom view of the connector from the plane indicated by the line 2—2 of FIG. 1.

This locking fuction occurs when two similar connector members 10 are associated by engaging their blade inner surfaces 28 with the connector members placed at right angles as shown in FIG. 1 of U.S. Pat. 1,834,150. In this position, the respective projections 36 each engage the recess 35 of the other connector member (or a similar recess depending upon the form of the connector). The connectors may then be turned to 180° in-line positions as shown in FIG. 2 of U.S. Pat. No. 1,834,150, wherein the projections are retained within the recesses 35 and the outer ends of the blades 23 pass within the slots 24 so that the connector members are locked together in fixed, and electrically conductive, engagement. To accomplish this purpose, it is thus seen that each arcuate recess 35 need have an angular length only sufficiently more than 90° to accommodate the width of the associated projections 36. Thus an arcuate length of as little as 100° or 110° may be sufficient. However, to accommodate connection with the lugs or pins of similar, though not identical, connector members, such as that shown in U.S. Pat. No. 1,834,150, it may be desirable to have the recess 35 of greater arcuate length, such as the approximately 200° arcuate length shown in the drawing.

As is known in the prior art and to provide for the engagement of two like or similar connector members in the manner previously described, the outer end of the blade 23 at a corner 43, opposite the position of the projection 36, is cut back, or rounded off, to permit entry of the blade into the slot 24. The opposite corner 44 of the blade end is preferably left square to provide a stop action upon engagement of the corner with the bottom of the slot 24 of the connected member 10. A saw cut slot 46 is provided in the end of the blade, intermediate the inner and outer sides, to provide a slight resilience of the outer end that permits entry of the blade and into the slot of an associated connector member and a frictional engagement of the sides to retain the parts in assembly.

In order to provide the degree of durability, or resistance to wear, desired in a connector member of this sort, the blade portion 15 of the connector member is made of substantially greater hardness than the soft crimpable barrel portion 14 at the other end of the connector member. This is accomplished, as will be subsequently more fully described, by working the material of the blade portion during manufacture by extrusion of the blade 24 and lug 26 to their final shapes.

MANUFACTURING PROCESS

Figure 6:
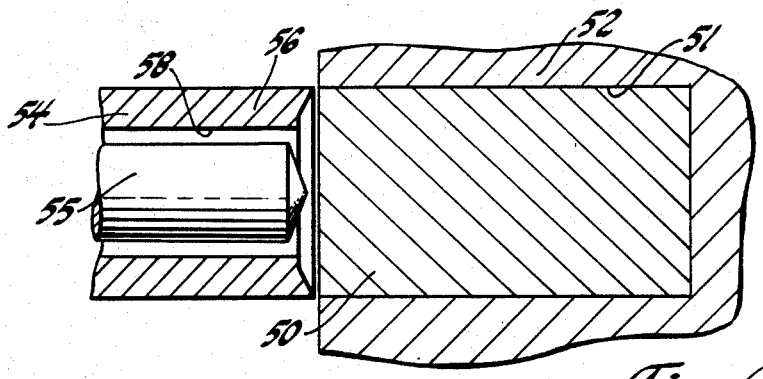
FIG. 6 is a cross-sectional view schematically illustrating the initial placement of a copper slug in a die in preparation for extrusion of the barrel portion of a connector.

In a first step of one possible process for forming a connector member in accordance with the invention, a generally cylindrical slug 50 of suitable material, such as extrudable copper of high electrical quality, for example CDA110 copper, is provided of predetermined suitable size. As illustrated in FIG. 6, the slug 50 is placed in a recess 51 of a die 52, opposite which is a male die portion 54 having a cylindrical central plunger 55 coaxially surrounded by a tubular outer plunger 56 to define a cylindrical space 58 therebetween.

Figure 7:
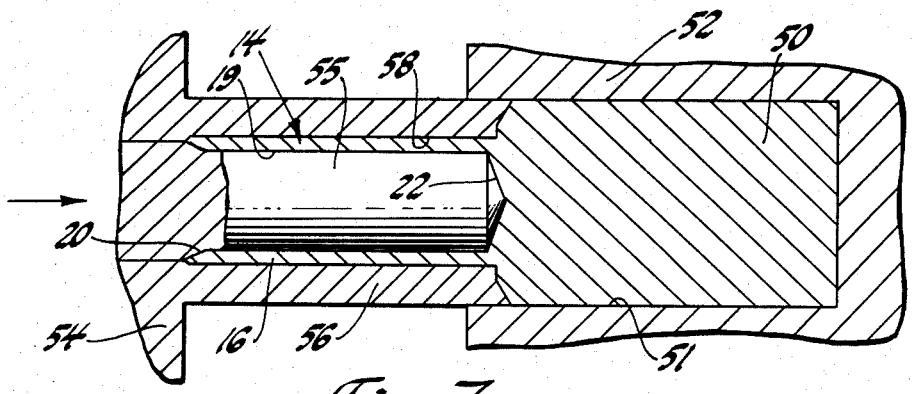
FIG. 7 is a cross-sectional view illustrating the position of the die members at the conclusion of the initial extrusion step.

In accordance with known extrusion processes, and as shown in FIG. 7, the male die portion 54 is subsequently advanced into the recess 51, extruding a portion of the slug 50 into the space 58 of the male die portion to form the barrel portion 14 of the connector member.

The partially formed member is then removed from the dies and is annealed by heating to a temperature of about 750° F. and cooling to produce a dead soft hardness below about 35 Rockwell "F" (35 HRF) and preferably between 15 and 30 HRF, adequate to permit crimping of the barrel portion in subsequent use.

Figure 8:
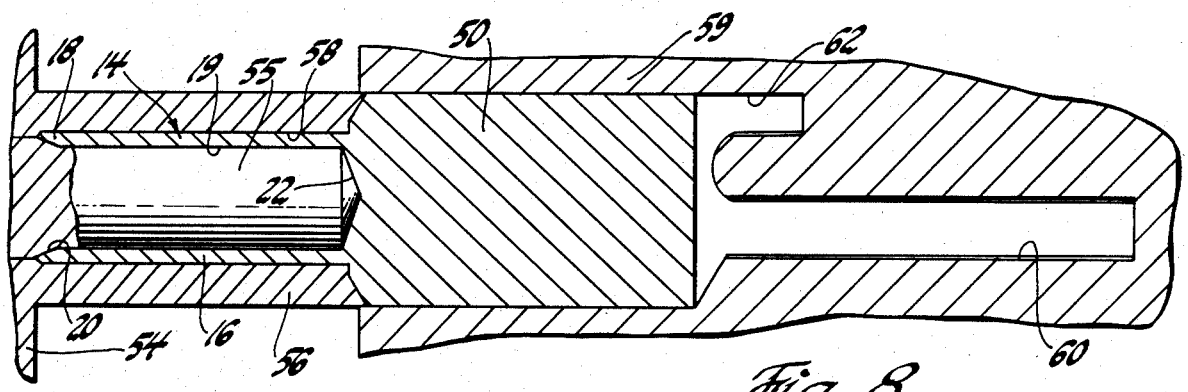
FIG. 8 is a cross-sectional view illustrating the position of die members prior to the second step of extrusion of the blade portion of the connector.
Figure 9:
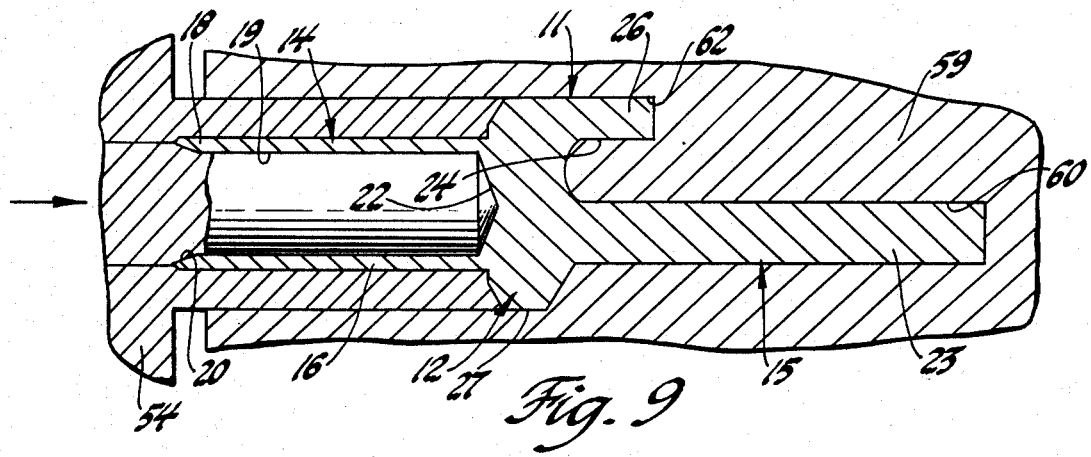
FIG. 9 is a cross-sectional view showing the position of the die members at the end of the second extrusion step.

After annealing, the partially finished part 50, as shown in FIG. 8, is again inserted with the barrel portion 14 in a male die portion 54 (to protect the barrel against deformation). The remaining portion of the slug 50 is inserted into a different female die 59 having recesses 60, 62 adapted to form the blade and lug of the blade portion.

The male die 54 is then advanced, causing extrusion of the end of the slug 50 opposite the barrel 14 into the cavities 60, 62 to form the blade 23 and lug 26 with the intermediate slot 24 of the blade portion 15 of the connector. This extrusion step work hardens the material in the connector portion so that the blade and lug are hardened to a hardness of at least 50 HRF and preferably 90–100 HRF, sufficient to provide desired wear resistance in subsequent use. However, the dead soft condition of the barrel portion 14 is maintained by avoiding further working of the barrel material through its protective retention within the male die 54.

Figure 10:
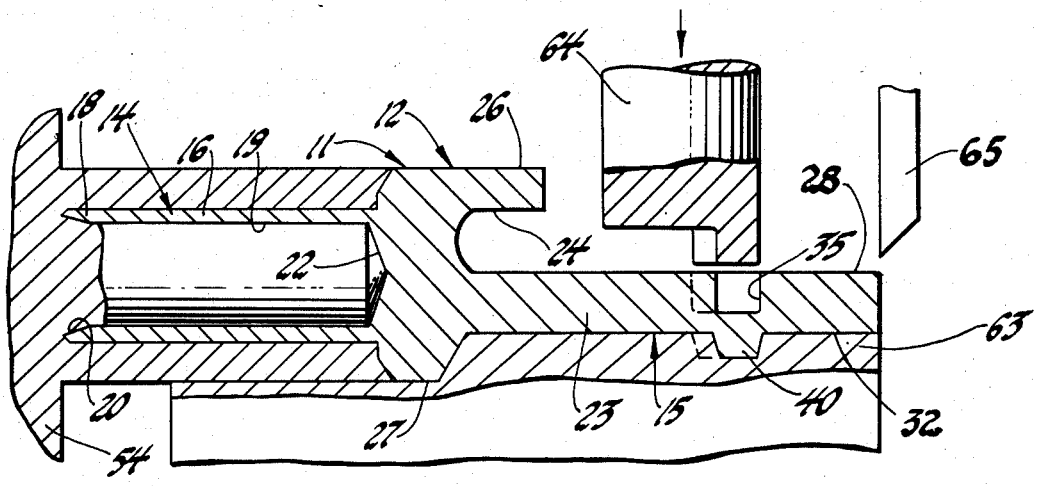
FIG. 10 is a cross-sectional view illustrating die members in a retracted position following a trimming and third extrusion step involving formation of a lock portion.

As shown in FIG. 10, the recess 35 is subsequently formed to open through the inner surface 28 of the blade 23 by backing the blade with a female die 63 and forcing material from the blade with a punch 64 to form the recess 35 and the opposite projection 40 on the blade outer side. Preferably at the same time, the end of the blade, including the rounded corner 43 and square corner 44, is trimmed to the desired length by a shearing blade 65.

If desired, the lock projection 36 may be similarly formed at the same, or a subsequent, time through the use of a similar die and punch to extrude the projection 36—as shown by FIG. 5 in its desired location. Thus, oppositely acting punch like dies might be utilized to form both the recess 35 and the projection 36 at the same time. Alternatively, as in the first described embodiment, the projection 36 may be provided by drilling or punching a hole through the blade 23 and pressing in a pin 38.

Figure 11:
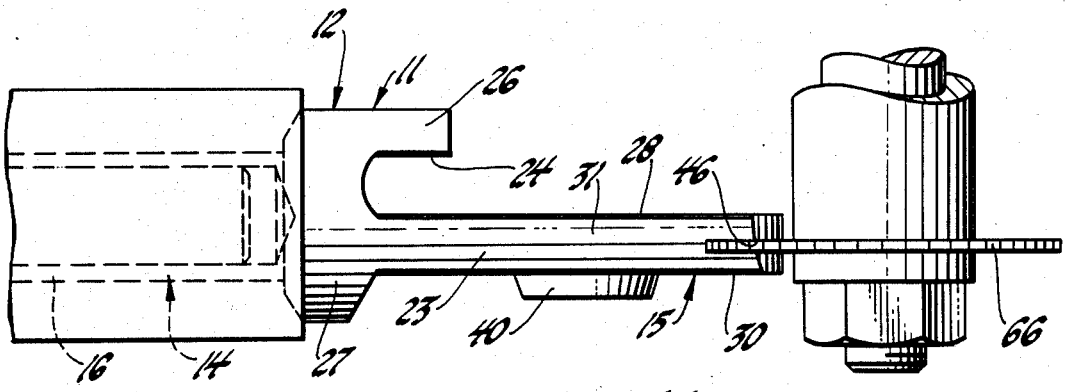
FIG. 11 is a top view illustrating the step of sawing the slot at the end of the blade portion.

Finally, the saw cut slot 46 may be formed as shown in FIG. 11 by machining the slot 46 into the blade end by a circular saw blade 66 or other suitable means.

If desired, various modified forms of connectors, not shown but having similar features, may be made in accordance with the invention by the same or similar processes. For example, the clasp connector constructions of FIGS. 1–5 may be modified for use as bolted connectors by deleting the pin and groove lock portions and providing through-bolt openings through the blades 23.

In one embodiment of bolted connector, the lug or jaw 26 is omitted or removed during manufacture so that only a single blade is provided for connection to another like member. In an alternative embodiment, the jaw 26 is extended to a length equal to that of the blade 23 and the bolt openings go through both the blade and jaw. This arrangement provides interlocking contact with the blade and jaw of a mating bolt type connector.

While the invention has been described by reference to certain preferred embodiments chosen for purposes of illustration, it should be understood that numerous changes could be made within the spirit and scope of the inventive concepts described. Accordingly, it is intended that the invention not be limited to the described embodiments, but that it have the full scope permitted by the language of the following claims.

The embodiments of the invention in which an exclusive property or privilege is claimed are defined as follows:

1. A clasp connector member for locomotive traction motor cables and the like, said member having an integral body of electrically conductive material and generally elongated configuration having first and second opposite end portions joined by a central portion, said first end portion defining thinwall tubular socket for receiving the end of a flexible conductor, said socket being of sufficiently low hardness to permit crimping the socket into tight engagement with the conductor, said second end portion defining a long tongue and a short jaw separated by a slot of width substantially equal to that of at least the extreme end of the tongue, said tongue having retaining means on a side thereof toward the slot for cooperating with like means of a mating connector member to aid in joining and retaining said members in assembly, the tongue and jaw of said second end portion being of substantially greater hardness than said first end portion to provide resistance to abrasion and wear, and said clasp connector member being made by a method including the steps of providing a slug of work hardenable conductive material in relatively soft extrudable condition, extruding said thinwall tubular socket from one end of the slug to form said first end portion of said connector, annealing the first end portion to soften the formed socket to a hardness suitable for crimping, and extruding said tongue, jaw and slot from an opposite end of the slug to form said second end portion, the extrusion of said second end portion causing work hardening of the material thereof to provide said wear resisting greater hardness of the tongue and jaw while maintaining the socket of the first end portion in said soft crimpable condition.

2. A clasp connector member for locomotive traction motor cables and the like, said member having an integral body of electrically conductive material and generally elongated configuration having first and second opposite end portions joined by a central portion, said first end portion defining a thinwall tubular socket for receiving the end of a flexible conductor, said socket being of sufficiently low hardness to permit crimping the socket into tight engagement with the conductor, said second end portion defining a long tongue and a short jaw separated by a slot of width substantially equal to that of at least the extreme end of the tongue, said tongue having retaining means on a side thereof toward the slot for cooperating with like means of a mating connector member to aid in joining and retaining said members in assembly, the tongue and jaw of said second end portion being of substantially greater hardness than said first end portion to provide resistance to abrasion and wear, and said clasp connector member being made by a method including the steps of providing a slug of work hardenable conductive material in relatively soft extrudable condition, extruding said thinwall tubular socket from one end of the slug to form said first end portion of said connector, annealing the first end portion to soften the formed socket to a hardness suitable for crimping, extruding said tongue, jaw and slot from an opposite end of the slug to form said second end portion, the extrusion of said second end portion causing work hardening of the material thereof to provide said wear resisting greater hardness of the tongue and jaw while maintaining the socket of the first end portion in said soft crimpable condition, and extruding said part circular recess in said tongue to partially form said retaining means.

3. A clasp connector as in claim 2 wherein the method further includes installing a pin in said tongue to form said protrusion portion of said retaining means.

4. A clasp connector as in claim 2 wherein the method further includes extruding said protrusion from said tongue to complete the formation of said retaining means.

5. A method of making a connector member, said method comprising the steps of providing a slug of work hardenable conductive material in relatively soft extrudable condition, extruding a thinwall tubular socket from one end of the slug to form a first end portion of said connector, annealing the first end portion to soften the formed socket to a hardness suitable for crimping, and extruding a long tongue from an opposite end of the slug to form a second end portion while maintaining the socket of the first end portion in said soft crimpable condition, the extrusion of said second end portion causing work hardening of the material thereof to provide wear resisting greater hardness of the tongue.

6. A method of making a clasp connector for locomotive traction motor cables and the like, said method comprising the steps of providing a slug of work hardenable conductive material in relatively soft extrudable condition, extruding a thinwall tubular socket from one end of the slug to form a first end portion of said connector, annealing the first end portion to soften the formed socket to a hardness suitable for crimping, extruding a tongue and jaw separated by a slot of width substantially equal to that of the extreme end of the tongue from an opposite end of the slug to form a second end portion while maintaining the socket of the first end portion in said soft crimpable condition, the extrusion of said second end portion causing work hardening of the material thereof to provide wear resisting greater hardness of the tongue and jaw, and extruding a part circular recess in said tongue to partially form retaining means.

7. A method as in claim 6 wherein the conductive material of the slug is essentially in accordance with Copper Development Association specification Copper No. 110.

8. A method as in claim 7 and including the further step of extruding from said tongue a protrusion extending from the side of the tongue toward the slot and spaced in annular alignment with and between the extreme ends of the recess.

* * * * *